United States Patent [19]

Jürgens

[11] Patent Number: 4,606,288

[45] Date of Patent: Aug. 19, 1986

[54] SEWING MACHINE NEEDLE GUIDING AND ALIGNING DEVICE

[75] Inventor: Erwin F. Jürgens, Hemmingen, Fed. Rep. of Germany

[73] Assignee: Union Special G.m.b.H., Stuttgart, Fed. Rep. of Germany

[21] Appl. No.: 785,194

[22] Filed: Oct. 7, 1985

[30] Foreign Application Priority Data

Oct. 27, 1984 [DE] Fed. Rep. of Germany ..... 3439387

[51] Int. Cl.[4] ..... D05B 55/06

[52] U.S. Cl. ..... 112/227; 112/260

[58] Field of Search ..... 112/227, 260, 199

[56] References Cited

U.S. PATENT DOCUMENTS

| | | | |
|---|---|---|---|
| 506,538 | 10/1893 | Onderdonk | 112/227 |
| 1,444,634 | 2/1923 | Moffatt | 112/227 |
| 3,044,427 | 7/1962 | Gardner et al. | 112/227 X |
| 3,065,717 | 11/1962 | Reimer | 112/199 X |
| 3,125,049 | 3/1964 | Redman | 112/227 X |
| 3,373,709 | 3/1968 | Gubbay et al. | 112/260 |
| 4,252,072 | 2/1981 | Draghicchio et al. | 112/199 |

*Primary Examiner*—Werner H. Schroeder
*Assistant Examiner*—Andrew M. Falik
*Attorney, Agent, or Firm*—John A. Schaerli

[57] ABSTRACT

In a sewing machine having at least one needle and one looper underneath a throat plate, a guiding and aligning device comprising, a permanent magnet positioned underneath the throat plate in the cloth feeding direction on one side only of the needle and positioned sufficiently close to the needle to attract the needle to the side toward the magnet, such that the needle is guided and aligned with respect to the looper.

3 Claims, 4 Drawing Figures

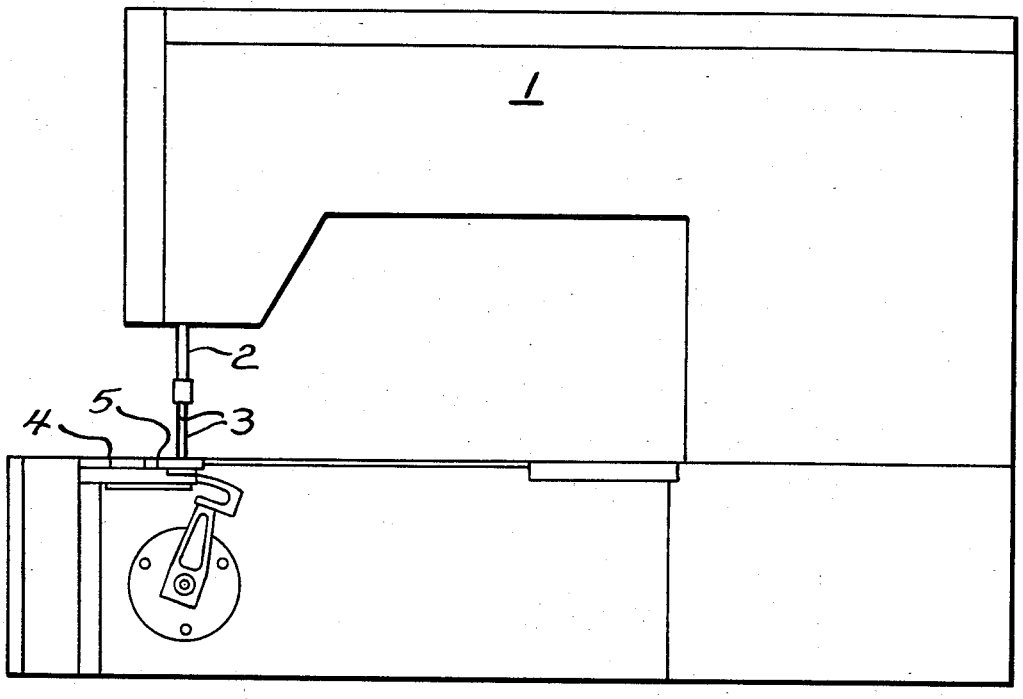
FIG. 1
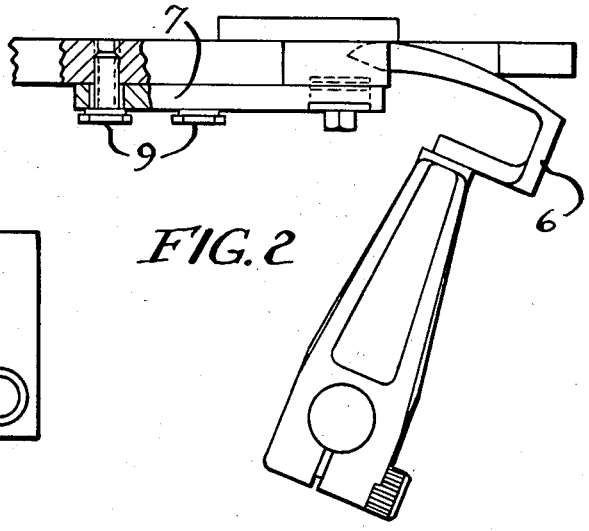
FIG. 2
FIG. 3
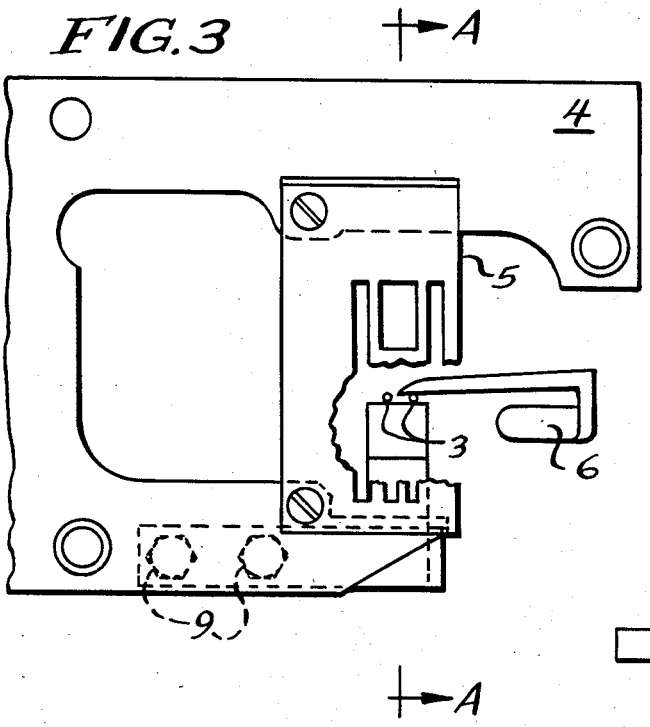
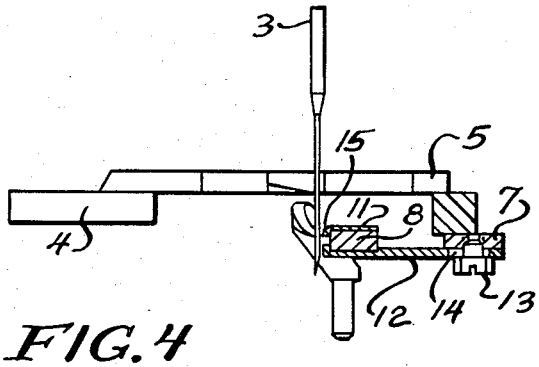
FIG. 4

SEWING MACHINE NEEDLE GUIDING AND ALIGNING DEVICE

BACKGROUND OF THE INVENTION

In chain stitch sewing machines it is known to provide guiding and aligning devices for the needle(s) in order to bring the looper or hook into the most favorable position for stitch formation and to prevent any collisions between the looper and the needle. Such guiding and aligning devices are to be seen, for example in German Pat. Nos. 368,861 and 410,952. However, these heretofore known devices prevent a deviation of the needle only one direction and prevent only marginally the vibration of the needle.

BRIEF SUMMARY OF THE INVENTION

The guiding and aligning is achieved by a permanent magnet means which attracts the needle steadily and aligns it in the desired direction. The vibrating needle is thereby stabilized and any deflection, caused for example by a cross seam, is corrected. Thus the needle is brought into its correct path of travel with respect to the hook.

Therefore, any object of this invention is to provide a simple needle guiding and aligning means in a sewing machine which suppresses the vibration of the needle and deviation of it in the various directions.

DESCRIPTION OF THE DRAWINGS

FIG. 1 represents a front view of a chain stitch sewing machine;

FIG. 2 is a partial view of the machine of FIG. 1 showing the stitch forming area;

FIG. 3 is a top view of the partial view shown in FIG. 2; and

FIG. 4 is a cross section along Line A—A.

DETAILED DESCRIPTION OF THE PREFERRED EMBODIMENT

Referring to FIG. 1, the illustrated chain stitch sewing machine represents the environment is necessary for the invention. A complete understanding of the machine may be gained from a consideration of the VX 600 manufactured by Union Special Corporation, Chicago, Ill. The housing of the sewing machine 1 supports in a usual manner an upward and downward moving needle bar 2 that has in this example two needles 3. The housing 1 has furthermore a support for receiving a throat plate 5 through which the needles 3 pass. Underneath the throat plate 5 moves a hook 6 which cooperates with the needles 3 for forming stitches. The hook 6 moves in the illustrated machine obliquely to the direction of the cloth feed movement, in order to penetrate into the loops of the needle threads. It executes the usual so called needle deflection movement. All of this is of course standard in the industry, thus no further mention will be made thereto.

A holder 7 for a permanent magnet 8 is attached by screws on the support 4 for receiving the throat plate 5. The permanent magnet 8 is supported between two plates 11, 12, which encompass the permanent magnet 8 on the side facing the needles 3. The plate 12 is attached by a screw 13 that penetrates through slot 14 to the support 7. The upper plate 11 has a slanted edge 15.

The guide portion for the needles 3 is posted by the edges of plates 11, 12 tightly to the needles 3. The descending needles 3 are attrated by the magnet 8 against the plates 11, 12 and held to it, whereby they pass in a precisely fixed position along the hook 6. The needles 3, strongly deflected to the magnets 8, are forced by the slanted edge 15 into this position.

Thus it is apparent that there has been provided, in accordance with the invention, SEWING MACHINE NEEDLE GUIDING AND ALIGNING DEVICE that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus adequately described the invention, what I claim is:

1. In a sewing machine having at least one needle means and one looper means underneath a throat plate means including a guiding and aligning device means comprising:

a permanent magnet means positioned underneath said throat plate means in the cloth feeding direction on one side only of the needle means and positioned sufficiently close to the needle means to attract the needle means to said side toward the magnet means whereby the needle means is guided and aligned with respect to the looper means.

2. A guiding and aligning device means according to claim 1 wherein said permanent magnet means is held between first and second plate means which project toward the needle means.

3. A guiding and aligning device means according to claim 2 wherein an upper one of the plate means has a slanted edge facing the needle means.

* * * * *